US009568018B2

(12) United States Patent
Dorman et al.

(10) Patent No.: US 9,568,018 B2
(45) Date of Patent: Feb. 14, 2017

(54) COVER PLATE FOR CABIN AIR COMPRESSOR

(71) Applicant: HAMILTON SUNDSTRAND CORPORATION, Windsor Locks, CT (US)

(72) Inventors: David A. Dorman, Feeding Hills, MA (US); Craig M. Beers, Wethersfield, CT (US); Peter A. Wierzbowski, Saybrook, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 379 days.

(21) Appl. No.: 14/291,226

(22) Filed: May 30, 2014

(65) Prior Publication Data

US 2015/0345506 A1 Dec. 3, 2015

(51) Int. Cl.
*F04D 29/46* (2006.01)
*F04D 29/62* (2006.01)

(52) U.S. Cl.
CPC ..... *F04D 29/462* (2013.01); *F04D 29/624* (2013.01)

(58) Field of Classification Search
CPC ..... F04D 29/40; F04D 29/46; F04D 29/60
USPC ..... 415/148, 150
See application file for complete search history.

(56) References Cited

U.S. PATENT DOCUMENTS

| | | | | |
|---|---|---|---|---|
| 4,844,690 | A | 7/1989 | DeLaurier et al. | |
| 5,207,559 | A | 5/1993 | Clevenger et al. | |
| 6,139,262 | A | 10/2000 | Ravidranath | |
| 6,158,956 | A | 12/2000 | Arnold | |
| 6,361,432 | B1 | 3/2002 | Walker | |
| 6,872,050 | B2 | 3/2005 | Nenstiel | |
| 8,915,704 | B2 * | 12/2014 | Severin | F01D 17/165 415/164 |
| 2012/0020776 | A1 | 1/2012 | Colson et al. | |
| 2012/0107101 | A1 | 5/2012 | Telakowski et al. | |
| 2012/0114463 | A1 * | 5/2012 | Beers | F04D 29/462 415/151 |

* cited by examiner

*Primary Examiner* — Nathaniel Wiehe
*Assistant Examiner* — Zubair Eltaf
(74) *Attorney, Agent, or Firm* — Carlson, Gaskey & Olds, PC

(57) ABSTRACT

A cover plate for use in a cabin air compressor is a generally cylindrical body with 19 holes extending through the body and an inner bore defining an inner diameter centered on a center axis. The body has a thickness in a dimension measured perpendicular to the central axis. The inner diameter is 14.840 inches (37.693 centimeters) plus/minus .005 inch (0.013 centimeter). A diffusor housing, a cabin air compressor and a method of replacing a cover plate are also disclosed.

20 Claims, 5 Drawing Sheets

COVER PLATE FOR CABIN AIR COMPRESSOR

BACKGROUND OF THE INVENTION

Air compressors are utilized in multiple applications on standard aircraft.

One such application is providing pressurized air to a passenger cabin or other pressurized compartment on the aircraft. Air compressors performing this function are typically referred to as "cabin air compressors."

It is often desirable for the volume of air passing through the cabin air compressor to be controlled. Thus, a diffuser may be provided with variable vanes to implement this control. The variable vanes may be driven by a drive ring moving relative to a diffuser.

A cover plate may be associated with the drive ring and rotating within a channel in the diffuser housing. In the past, this cover plate has sometimes binded during movement.

SUMMARY OF THE INVENTION

A cover plate for use in a cabin air compressor is a generally cylindrical body with 19 holes extending through the body and an inner bore defining an inner diameter centered on a center axis. The body has a thickness in a dimension measured perpendicular to the central axis. The inner diameter is 14.840 inches (37.693 centimeters) plus/minus .005 inch (0.013 centimeter).

In other aspects, a diffuser housing, a cabin air compressor, and a method are disclosed.

These and other features may be best understood from the following drawings and specification.

DETAILED DESCRIPTION

Figure 1:
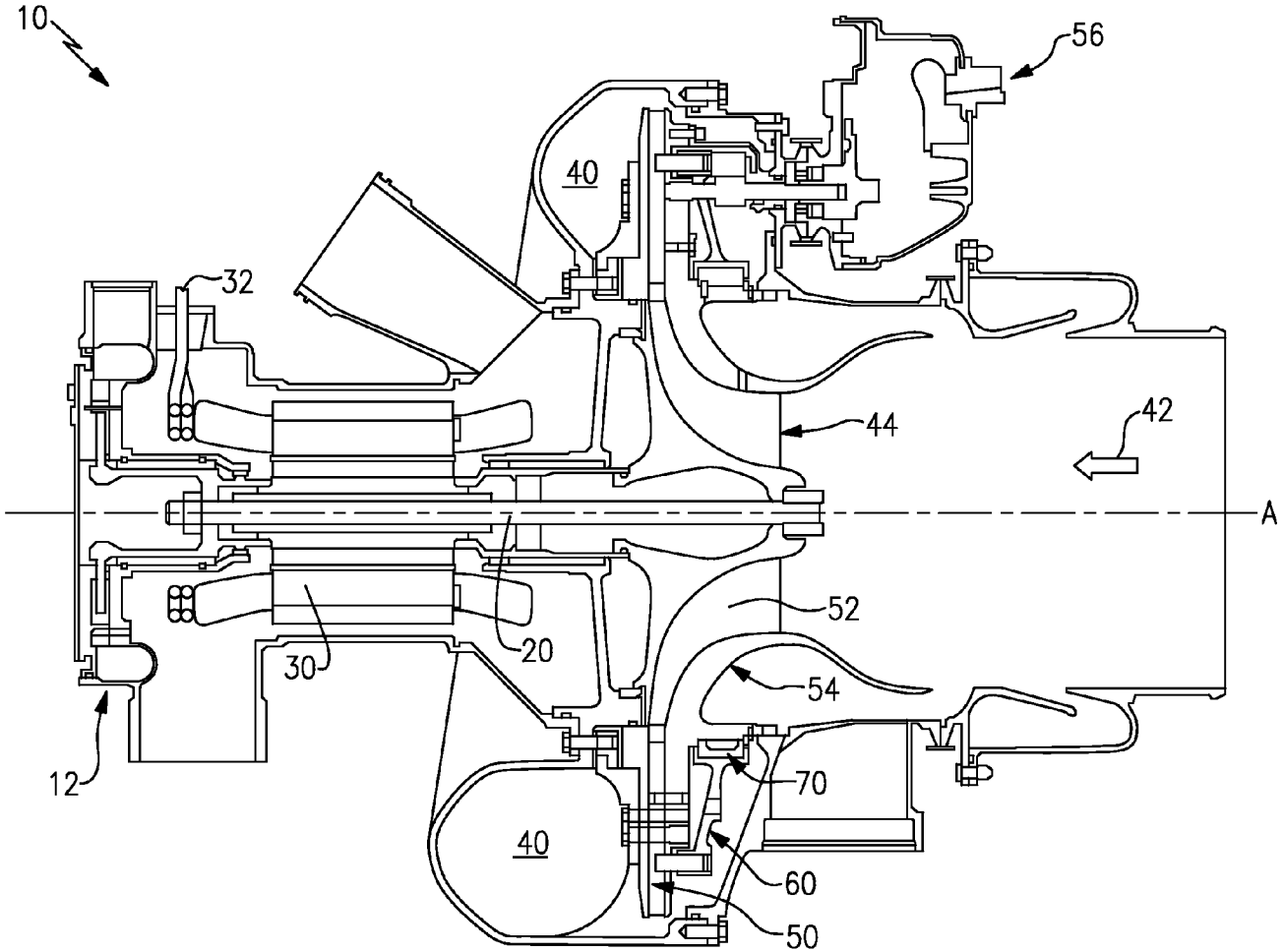
FIG. 1 schematically shows a cabin air compressor.

FIG. 1 illustrates a cabin air compressor 10 for use in a commercial aircraft. Cabin air compressor 10 has a compressor shaft 20 running through the center and defining a rotational axis A. The shaft 20 is connected at one end to an electric motor 30 that receives electrical power from a power input 32. The electric motor 30 converts the input electric power into rotational motion using standard motor technology, and imparts the rotational movement onto the shaft 20. The electric motor 30 is contained within a motor housing 12 in the cabin air compressor 10.

A compressor impeller 44 draws the air into the cabin air compressor 10 through an air inlet 42. The air is passed through a compressor outlet 40 through an air passage 52 defined by a passage wall of a diffuser housing 54 and the impeller 44. Between the end of the air passage 52 and the compressor outlet 40 are multiple diffuser vanes 50 spaced circumferentially about the axis A. Each of the diffuser vanes 50 is rotatable and a cross-sectional area of each of the diffuser vanes 50 relative to the gas flow through the air passage 52 changes dependent on the particular rotation or orientation of the diffuser vanes 50. A cross-sectional area, in turn, restricts or opens the connection between the air passage 52 and the compressor outlet 40. This thereby controls the volume of gas flowing through the cabin air compressor 10 at any given time.

Each of the diffuser vanes 50 is connected to a drive ring 60 that controls the rotational position of the diffuser vanes 50. The diffuser vanes 50 are connected to the drive ring 60 via multiple drive ring engagement pins (illustrated below). The angular position of the drive ring is controlled by a diffuser actuator 56 that rotates the drive ring 60. There is a connection between the drive ring 60 and the diffuser vanes 50, such that rotation of the drive ring 60 causes the diffuser vanes 50 to move and thereby restrict or open a connection between the airflow passage 52 and the compressor outlet 40.

Figure 2A:
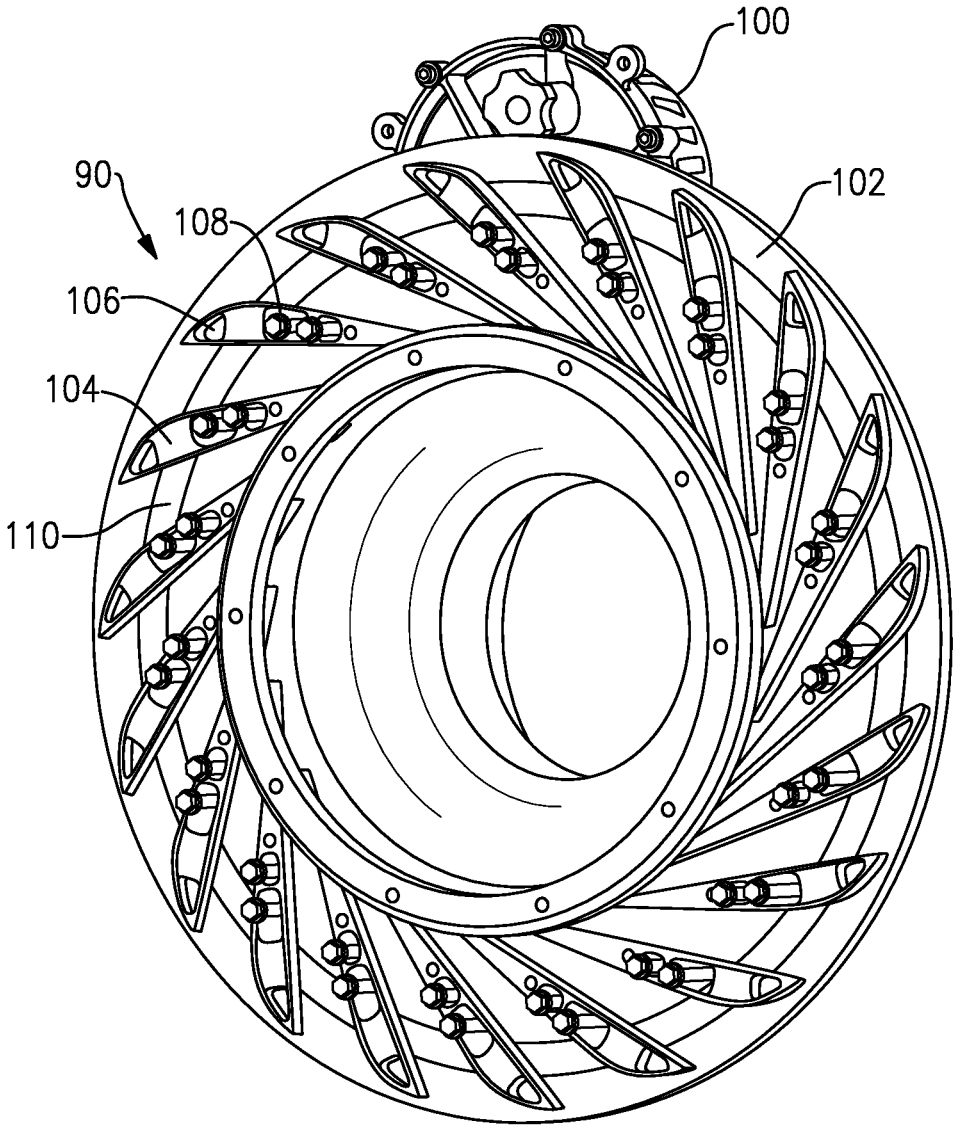
FIG. 2A shows a first view of a diffuser.

FIG. 2A shows a diffuser embodiment 90 which may be incorporated into cabin air compressor 10 of FIG. 1. The actuator 100 is illustrated along with a diffuser housing 102. Diffuser vanes 104 move about fixed pins 108 which are part of the diffuser housing 102. A drive ring cover plate 110 sits between the vanes 104 and the diffuser housing 102. As the drive ring rotates, the cover plate rotates. The cover plate 110 prevents leakage to ensure optimized performance. In the past, as the diffuser heats and the vanes are actuated, the cover may expand radially, as may the diffuser housing. This has sometimes resulted in binding.

Figure 2B:
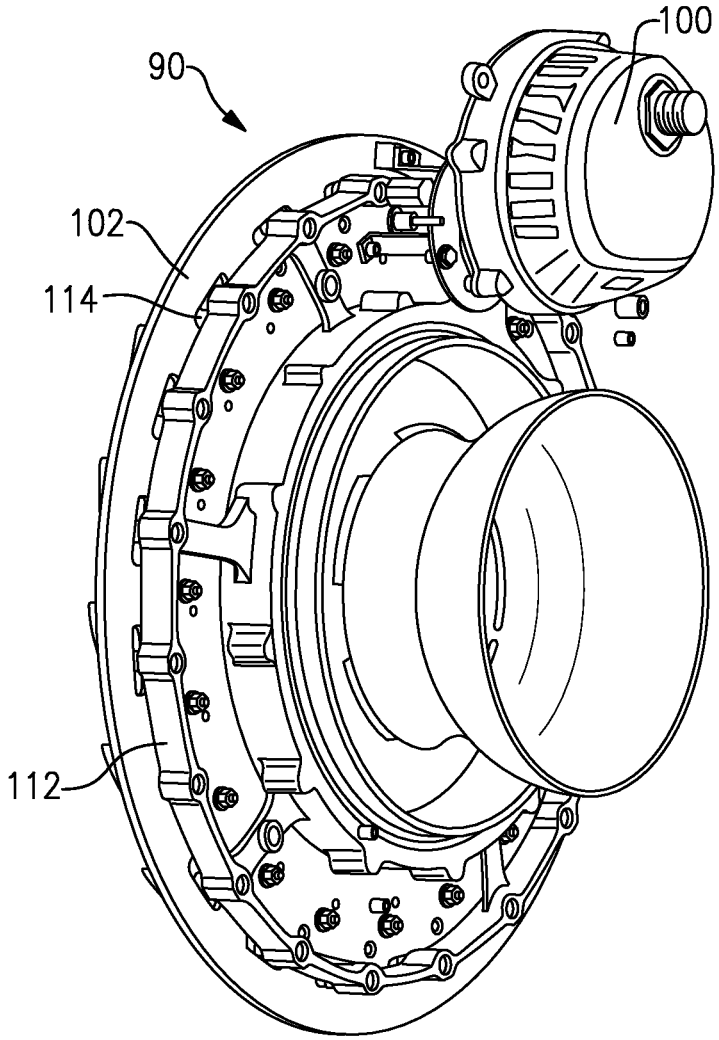
FIG. 2B shows the reverse side of the diffuser.

FIG. 2B shows the reverse side of the assembly 90 of FIG. 2A. The drive ring 112 is now illustrated, as are slots 114 formed through the diffuser housing 102.

Figure 3A:
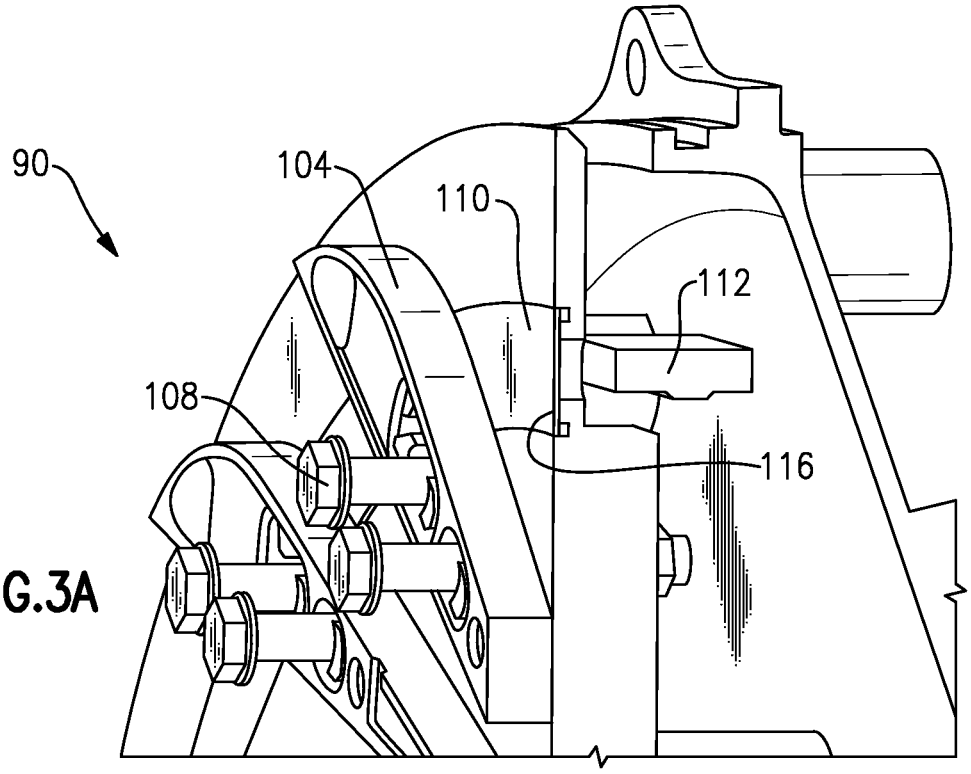
FIG. 3A shows a detail.
Figure 3B:
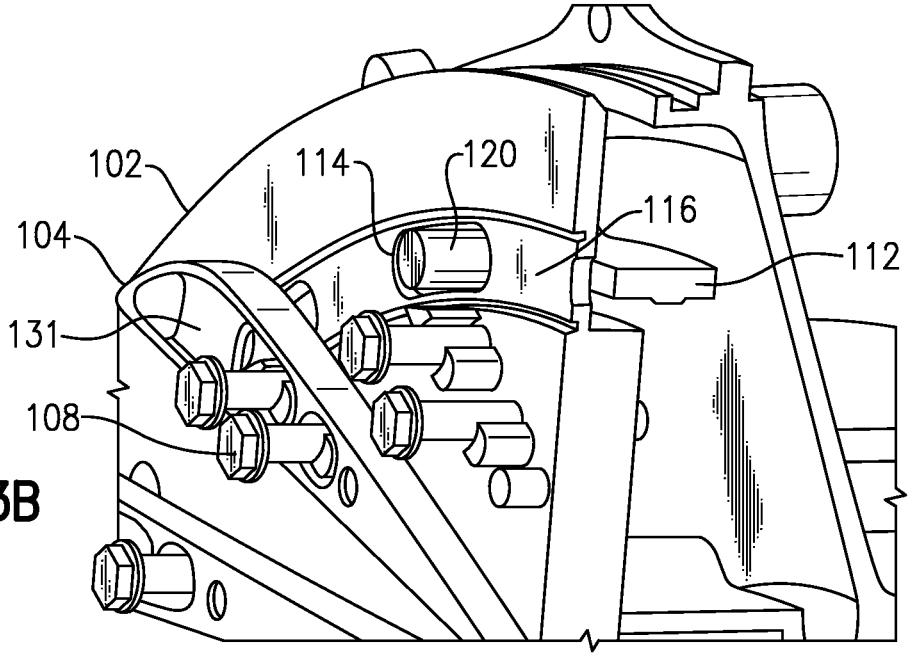
FIG. 3B shows another detail.

FIG. 3A shows a detail of the diffuser assembly 90. As shown, the cover plate 110 slides within the channel 116 in the diffuser housing 102. Pins 108 mount the vanes 104 for movement to restrict or allow flow. As the drive ring 112 rotates, the cover plate 110 rotates with it. This is because, as shown in FIG. 3B, there are moving pins 120 on the drive ring 112 which move within the slots 114 in the diffuser housing 102. Those pins 120 extend through holes in the cover plate (disclosed below) such that as the drive ring 112 rotates, the cover plate rotates with it.

The drive pins 120 extend into an area 131 of the vanes 104 such that they drive the vanes when pivoting. The assembly as disclosed to this point may be generally as known.

Figure 4A:
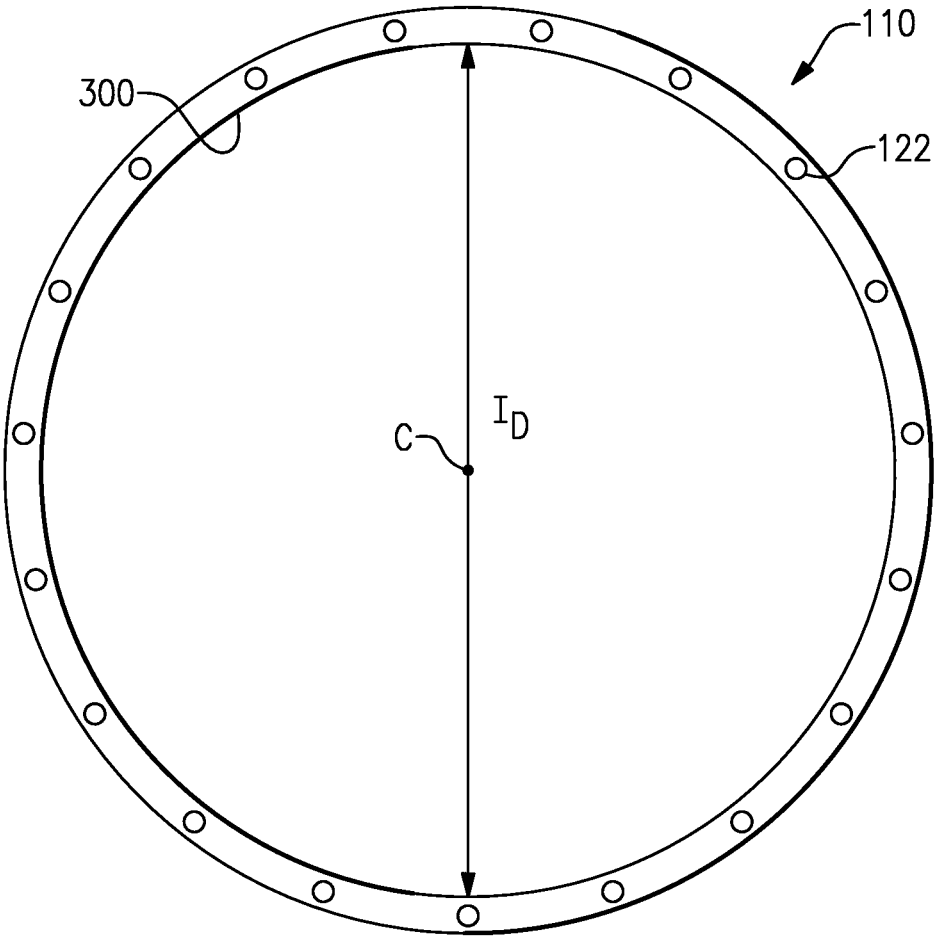
FIG. 4A shows a cover plate.

FIG. 4A shows the cover plate 110. There are 19 holes 122 to receive the pins 120. An inner diameter $I_D$ of an inner bore 300 is illustrated.

Figure 4B:
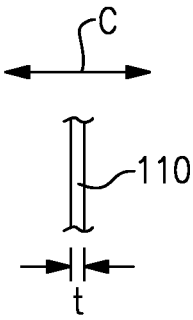
FIG. 4B shows another feature of the cover plate of FIG. 4A.

FIG. 4B shows a thickness t of the cover plate 110 along a dimension generally parallel to the central axis C of the drive ring 112.

In an embodiment, $I_D$ is 14.840 inches (37.69 centimeters) plus/minus .005 inch (0.0127 centimeters). In the prior art, this dimension was 14.825 inches (37.655 centimeters).

The thickness t is 0.025 inch (0.0635 centimeters) plus/minus 0.001 inch (0.00254 centimeters). In the prior art, this same thickness was utilized. However, by utilizing the enlarged inner diameter, this disclosure reduces the binding as mentioned above. A ratio of $I_D$:t in cover plates according to this disclosure would be between 592.8-593.2.

In embodiments, the cover plate is formed of 300 series corrosion resistant steel or similar alloy of equivalent material properties.

One disclosed diffuser assembly 90 and a cabin air compressor 10 have a diffuser housing 102 having a forward face including a circumferential groove 116 and a plurality of slots 114 formed through a thickness of the diffuser housing 102 in the groove. The diffuser housing 102 has a plurality of static pins. A plurality of vanes 104 are mounted on the static pins 108. A drive ring 122 has moving pins 120 extending through the slots and into openings in the plurality of vanes. An actuator 100 causes the drive ring 112 to rotate. The moving pins 120 move within the slots 114 in the diffuser housing to adjust the plurality of vanes 104. A cover plate 110 is mounted in the circumferential groove 116 and has 19 holes. The moving pins 120 extend through the holes and into openings in the plurality of vanes. The cover plate 120 is cylindrical and has an inner bore defining an inner diameter $I_D$. The inner diameter $I_D$ is 14.840 inches (37.693 centimeters) plus/minus .005 inch (0.013_centimeter).

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A cover plate for use in a cabin air compressor comprising:

a generally cylindrical body with 19 holes extending through said body, and an inner bore defining an inner diameter centered on a center axis, said body having a thickness in a dimension measured perpendicular to said central axis; and said inner diameter is 14.840 inches (37.693 centimeters) plus/minus .005 inch (0.013 centimeter).

2. The cover plate as set forth in claim 1, wherein said body is formed of corrosion resistant steel.

3. The cover plate as set forth in claim 2, wherein said body having a thickness in a dimension measured perpendicular to said central axis, and a ratio of said inner diameter to said thickness being between 592.8 and 593.2.

4. The cover plate as set forth in claim 3, wherein said thickness is 0.025 inch (0.0635 centimeter) plus/minus 0.001 inch (0.00254 centimeter).

5. The cover plate as set forth in claim 1, wherein said body having a thickness in a dimension measured perpendicular to said central axis, and a ratio of said inner diameter to said thickness being between 592.8 and 593.2.

6. The cover plate as set forth in claim 5, wherein said thickness is 0.025 inch (0.0635 centimeter) plus/minus 0.001 inch (0.00254 centimeter).

7. A diffuser assembly for use in a cabin air compressor comprising:

a diffuser housing having a forward face including a circumferential groove and a plurality of slots formed through a thickness of said diffuser housing in said groove, said diffuser housing having a plurality of static pins;

a plurality of vanes mounted on said static pins;

a drive ring, said drive ring having moving pins extending through said slots and into openings in said plurality of vanes;

an actuator for causing said drive ring to rotate, with said moving pins moving within said slots in said diffuser housing to adjust said plurality of vanes; and a cover plate mounted in said circumferential groove, said cover plate having 19 holes, and said moving pins extending through said holes and into said openings in said plurality of vanes, and said cover plate being cylindrical and having an inner bore defining an inner diameter, and said inner diameter is 14.840 inches (37.693 centimeters) plus/minus .005 inch (0.013 centimeter).

8. The diffuser assembly as set forth in claim 7, wherein said cover plate is formed of corrosion resistant steel.

9. The diffuser assembly as set forth in claim 8, wherein said cover plate having a thickness in a dimension measured perpendicular to said central axis, and a ratio of said inner diameter to said thickness being between 592.8 and 593.2.

10. The diffuser assembly as set forth in claim 9, wherein said thickness is 0.025 inch (0.0635 centimeter) plus/minus 0.001 inch (0.00254 centimeter).

11. The diffuser assembly as set forth in claim 7, wherein said cover plate having a thickness in a dimension measured perpendicular to said central axis, and a ratio of said inner diameter to said thickness being between 592.8 and 593.2.

12. The diffuser assembly as set forth in claim 11, wherein said thickness is 0.025 inch (0.0635 centimeter) plus/minus 0.001 inch (0.00254 centimeter).

13. A cabin air compressor comprising:

an electric motor for rotation about a central axis, said electric motor driving a shaft to, in turn, drive a compressor impeller, said compressor impeller rotating within a diffuser housing, said diffuser housing having a forward face including a circumferential groove and a plurality of slots formed through a thickness of said diffuser housing in said groove, said diffuser housing having a plurality of static pins;

a plurality of vanes mounted on said static pins;

a drive ring, said drive ring having moving pins extending through said slots and into openings in said plurality of vanes;

an actuator for causing said drive ring to rotate, with said moving pins moving within said slots in said diffuser housing to adjust said plurality of vanes; and a cover plate mounted in said circumferential groove, said cover plate having 19 holes, and said moving pins extending through said holes and into said openings in said plurality of vanes, and said cover plate being cylindrical and having an inner bore defining an inner diameter, and said inner diameter is 14.840 inches (37.693 centimeters) plus/minus .005 inch (0.013 centimeter).

14. The cabin air compressor as set forth in claim 13, wherein said cover plate is formed of corrosion resistant steel.

15. The cabin air compressor as set forth in claim 14, wherein said cover plate having a thickness in a dimension measured perpendicular to said central axis, and a ratio of said inner diameter to said thickness being between 592.8 and 593.2.

16. The cabin air compressor as set forth in claim 15, wherein said thickness is 0.025 inch (0.0635 centimeter) plus/minus 0.001 inch (0.00254 centimeter).

17. The cabin air compressor as set forth in claim 13, wherein said cover plate having a thickness in a dimension measured perpendicular to said central axis, and a ratio of said inner diameter to said thickness being between 592.8 and 593.2.

18. The cabin air compressor as set forth in claim 17, wherein said thickness is 0.025 inch (0.0635 centimeter) plus/minus 0.001 inch (0.00254 centimeter).

19. A method of replacing a cover plate comprising the steps of:

removing a cover plate from a diffuser assembly which includes a diffuser housing having a forward face including a circumferential groove and a plurality of slots formed through a thickness of said diffuser housing in said groove, said diffuser housing having a plurality of static pins, a plurality of vanes being mounted on said static pins, a drive ring having rotating pins extending through said slots and into openings in said plurality of vanes, an actuator for causing said drive ring to rotate, with said moving pins moving within said slots in said diffuser housing to adjust said plurality of vanes, the cover plate being previously mounted in said circumferential groove; and then replacing said removed cover plate with a new cover plate having 19 holes, and said moving pins extending through said holes and into said openings in said diffuser vanes, and said new cover plate being cylindrical and defining an inner diameter, and said inner diameter is 14.840 inches (37.693 centimeters) plus/minus .005 inch (0.013 centimeter).

20. The method as set forth in claim 19, wherein said cover plate is formed of a corrosion resistant steel, and having a thickness defined perpendicular to a central axis of said cover plate, with a ratio of said inner diameter to said thickness being between 592.8 and 593.2.

* * * * *